US005494280A

United States Patent [19]

MacKay, Jr.

[11] Patent Number: 5,494,280

[45] Date of Patent: Feb. 27, 1996

[54] CONCAVE END CAP WITH CONE LOAD FOR BATS

[76] Inventor: Jack W. MacKay, Jr., Rte. 9, Box 185, Mt. Pleasant, Tex. 75455

[21] Appl. No.: 358,549

[22] Filed: Dec. 14, 1994

Related U.S. Application Data

[63] Continuation-in-part of Ser. No. 99,348, Jul. 30, 1993, Pat. No. 5,421,572.

[51] Int. Cl.[6] ..... A63B 59/06

[52] U.S. Cl. ..... 273/72 A

[58] Field of Search ..... 273/72 A, 72 R, 273/67 R, 80

[56] References Cited

U.S. PATENT DOCUMENTS

| | | | |
|---|---|---|---|
| 1,499,128 | 6/1924 | Shroyer, Jr. . | |
| 1,611,858 | 12/1926 | Middlekauff . | |
| 3,116,926 | 1/1964 | Owen et al. | 273/72 |
| 3,727,295 | 4/1973 | Gildemeister | 273/72 A |
| 3,779,551 | 12/1973 | Wilson | 273/72 |
| 3,811,596 | 5/1974 | Wilson | 220/24 |
| 3,861,682 | 1/1975 | Fujii | 273/72 |
| 3,955,816 | 5/1976 | Bratt | 273/26 |
| 3,963,239 | 6/1976 | Fujii | 273/72 |
| 4,241,919 | 12/1980 | Foreman | 273/72 |
| 4,744,136 | 5/1988 | Foreman et al. | 29/451 |
| 4,763,899 | 8/1988 | Hundley | 273/26 |
| 4,834,370 | 5/1989 | Noble et al. | 273/72 A |
| 4,844,460 | 7/1989 | Mitchell et al. | 273/72 |
| 5,114,144 | 5/1992 | Baum | 273/72 |

FOREIGN PATENT DOCUMENTS 962291 2/1975 Canada .

OTHER PUBLICATIONS

Hillersch & Bradsby; Advertisement Oct. 1977.

*Primary Examiner*—Mark S. Graham

*Attorney, Agent, or Firm*—Jacobson, Price, Holman & Stern

[57] ABSTRACT

An end cap for a hollow aluminum bat having a barrel with a substantially constant external diameter area defining a hitting zone. The end cap is constructed of rigid plastic material and includes a reduced diameter inner end which telescopes into the end of the bat. The barrel includes a peripheral groove in the internal surface adjacent the end of the bat and the reduced end of the cap includes a peripheral ridge received in the groove to anchor the end cap to the barrel. The distal end of the end cap is constructed with a concave end surface which moves the weight of the end cap axially inwardly in relation to the end of the aluminum bat. The end cap may include a conically shaped solid weight area extending axially inwardly from the inner surface of the end cap to increase the load at the end of the bat and also move the increased load inwardly in relation to the end of the bat.

16 Claims, 2 Drawing Sheets

CONCAVE END CAP WITH CONE LOAD FOR BATS

CROSS REFERENCE TO RELATED APPLICATION

This application is a continuation-in-part of my application U.S. Ser. No. 08/099,348 filed Jul. 30, 1993 for FULL BARREL ALUMINUM BASEBALL BAT AND END CAP, now U.S. Pat. No. 5,421,572 issued Jun. 6, 1995.

BACKGROUND OF THE INVENTION

1. Field of the Invention

The present invention generally relates to baseball and softball bats of hollow aluminum construction and more specifically to an end cap for an aluminum baseball or softball bat. The end cap is made of a polymer material having a concave outer end surface and includes a reduced diameter portion telescoped into the end of a hollow aluminum bat. The end cap also includes a hollow interior with radial reinforcing flanges. The end cap may also include a conically shaped solid portion forming a weight extending inwardly to increase the load at the end of the bat and also move the increased load inwardly in relation to the end of the bat. The end cap also dampens vibration of the aluminum bat when impacting a ball.

2. Description of the Prior Art

Aluminum bats have been in use for a number of years and are typically of hollow construction and provided with the usual handle portion and barrel portion having predetermined dimensional characteristics. An end cap is usually provided for closing the open end of the barrel portion of the aluminum bat. However, in prior known bat construction including an aluminum barrel, the barrel typically has a larger diameter than the standard diameter end cap. This requires that the end portion of the barrel of the bat be decreased slightly in diameter, or crimped at the end in order to enable the standard diameter end cap to be used. The following prior art discloses various developments in this field of endeavor.

| U.S. Pat. Nos. | |
|---|---|
| 1,499,128 | 3,955,816 |
| 1,611,858 | 3,963,239 |
| 3,116,926 | 4,241,919 |
| 3,727,295 | 4,744,136 |
| 3,779,551 | 4,763,899 |
| 3,811,596 | 4,844,460 |
| 3,861,682 | 5,114,144 |
| Canadian Patent | |
| 962291 | |

While the prior art discloses various aluminum bat structures, the prior art does not disclose an end cap constructed in a manner and including a diameter which enables the barrel end of the aluminum bat to maintain a constant diameter throughout its length to the end thereof. Such a construction is shown in my earlier co-pending application, U.S. Ser. No. 08/099,348. Further, the prior art does not disclose an end cap for the open end of an aluminum bat in accordance with the invention of this application in which the end cap has a concave end wall so that the weight of the end cap is moved inwardly in relation to the end of the barrel of the bat. Additionally, the prior art does not disclose an end cap with a solid conical projection extending inwardly into the interior of the barrel at the end of the aluminum bat to effectively add weight inwardly of the end of the bat. The conical weight can be used without the concave end wall or combined therewith.

SUMMARY OF THE INVENTION

The present invention is intended primarily for aluminum baseball or softball bats of hollow construction and utilizing a tubular barrel having an enlarged constant diameter extending to the end of the barrel and utilizing an end cap having an external periphery of the same diameter as the internal diameter of the barrel. In this construction as disclosed in my co-pending parent application, Ser. No. 08/099,348, a step down crimp area or reduction in diameter area conventionally used when the diameter of the aluminum barrel end exceeds a predetermined maximum is eliminated. The increased diameter barrel length provides enhancement to the flexible zone or trampoline effect in the hitting zone of the bat.

A primary object of the present invention is to utilize an end cap constructed in a manner to move the weight center of the end cap axially inwardly of the end of the barrel portion of the bat to dampen vibration of the bat and shorten the lever arm between the handle portion of the bat and the weight center of the end cap and to move the weight center of the end cap closer to the preferred impact area of the barrel portion of the bat.

A further object of the present invention is to provide a bat and end cap as set forth in the preceding object in which the end cap is provided with a reduced diameter, generally cylindrical portion telescoped into the interior of the hollow aluminum bat, with the cylindrical area being hollow and reinforced by radial ribs. The end cap also includes an end wall which is of concave construction to form a concave recess in the distal end of the end cap and bat, resulting in the weight center of the end cap being moved axially inwardly of the end of the aluminum bat.

Another and distinct object of the present invention is to provide an aluminum bat and end cap in which a conical solid area projects inwardly from the interior of the end cap to increase the weight load of the end cap and move the center of the weight load inwardly in relation to the end of the bat, with the conical weight load extending with its apex either generally coinciding with the inner end of the cylindrical portion of the end cap or extending inwardly beyond the inner end of the cylindrical portion of the end cap. The end wall of the end cap can be either concave as stated in the previous objects or substantially straight across the end of the bat as in heretofore known constructions, with the conical weight extending to either defined extent and integrally combined with the end wall of the end cap.

Still another object of the invention is to provide an aluminum bat and end cap in which vibration characteristics of an aluminum bat are reduced by moving the weight center of the end cap axially inwardly of the end of the aluminum bat and adding a weight load inwardly of the end of the bat, with this inward disposition of the center of the load also reducing the lever arm between the handle portion of the bat and the center of the weight load to reduce the lever arm distance. By reducing the lever arm distance, a batter is able to obtain a more effective movement of the bat when impacting a ball and the center of the weight load is moved closer to the optimum impact area of the barrel portion of the bat.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
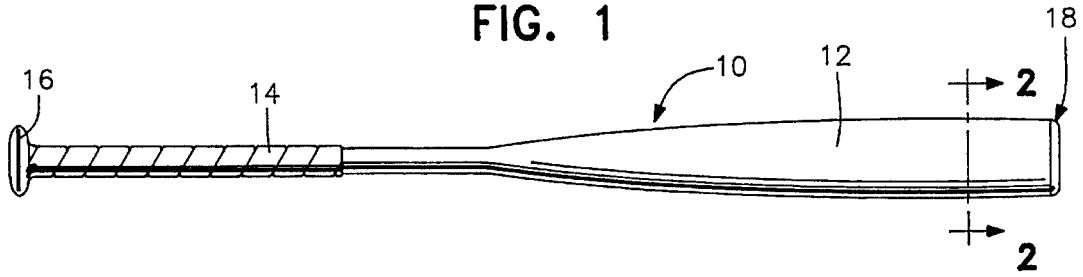
FIG. 1 is a side elevational view of the aluminum bat with the improved end cap of the present invention incorporated therein.
Figure 2:
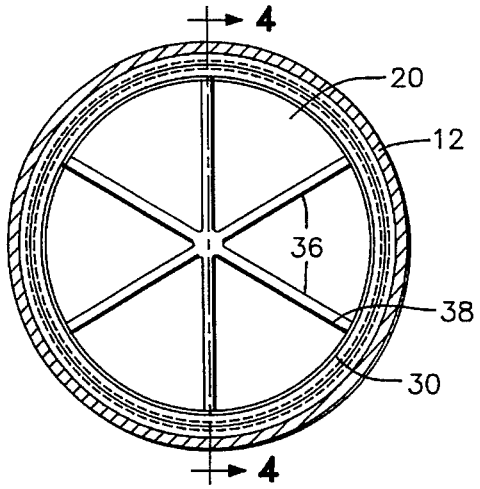
FIG. 2 is a transverse, sectional view of the bat taken along section line 2—2 on FIG. 1 and illustrating, on an enlarged scale, the configuration of the inner end of the improved end cap and its association with the barrel portion of the bat.

Referring now specifically to FIG. 1, the aluminum bat and end cap of the present invention is generally designated by reference numeral 10 and includes a tubular barrel 12 and a handle or hand grip area 14 having a knob 16 at one end thereof and an end cap generally designated by reference numeral 18 forming a closure for the barrel end of the bat. As illustrated in FIG. 1, the barrel 12 is of constant diameter completely to the end thereof and does not include any inwardly tapering area or any inward crimp as is conventionally used in previously known aluminum bats to enable an end cap of a predetermined diameter less than the major diameter of the barrel to be used.

Figure 4:
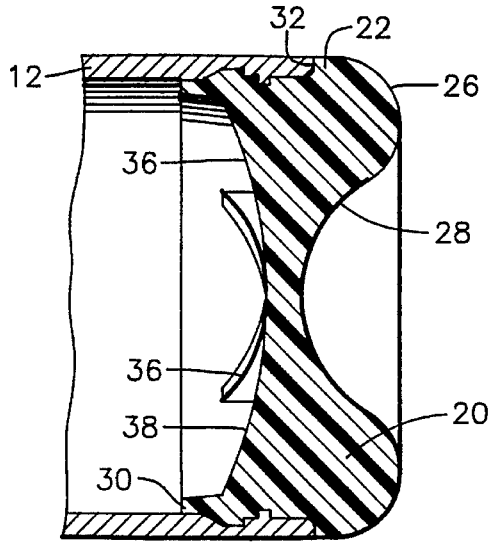
FIG. 4 is a sectional view, on an enlarged scale, taken along section line 4—4 on FIG. 2 illustrating the structure of the improved end cap and its association with the end of the barrel of the aluminum bat.

The end cap 18 is normally constructed of plastic material, preferably rigid polyurethane, and has an end wall 20 including a peripheral surface 22 of generally cylindrical configuration that is the exact same diameter as the exterior of the barrel 12 of the bat as illustrated in FIG. 4. The end wall 20 forms a closure for and is continuous throughout the peripheral extent of the barrel 12 and terminates in a rounded convex outer corner 26. The center portion of the end wall 20 is provided with a concave recess 28 which extends from the axial outer end of the end cap axially inwardly in relation to the barrel 12 as illustrated in FIG. 4. Preferably, as shown, the central axis of the concave recess 28 is coincident with the longitudinal central axis of the bat and bat barrel 12.

Figure 3:
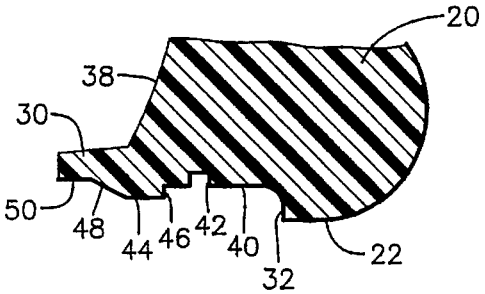
FIG. 3 is a fragmental enlarged sectional view illustrating the configuration of a portion of the periphery of the improved end cap.

The end wall includes a generally cylindrical reduced diameter inner end 30 which telescopes into the interior of the barrel 12 with the reduced diameter area 30 defining a shoulder 32 at the peripheral surface 22 which abuts the end of the barrel 12 as illustrated in FIG. 4. The reduced external diameter cylindrical portion 30 which telescopes into the barrel 12 includes radial reinforcing ribs or flanges 36 that curve outwardly from the inner surface of the end wall 20 to the interior of the reduced diameter portion 30. The inner edge surfaces of the ribs or flanges 36 are concavely curved at 38 to extend further inwardly toward the cylindrical edge of the end cap in order to provide additional rigidity to the reduced diameter portion 30. As shown in FIG. 3, the outer surface of the reduced diameter portion 30 includes a cylindrical area 40 inwardly of the shoulder 32, and inwardly extending peripheral groove 42 in the cylindrical area 40 spaced from the ends thereof with the cylindrical surface terminating in a slightly enlarged cylindrical surface 44 with a shoulder 46 facing the shoulder 32 and in spaced relation thereto. The cylindrical portion 44 terminates inwardly in an inclined portion 48 and an additional short cylindrical area 50. This corresponds to the internal shape and configuration at the open end of the barrel 12 which includes a corresponding flange 52 received in the groove 42 and a recess 54 receiving the peripheral rib or projection 44 as illustrated in FIG. 4.

Figure 5:
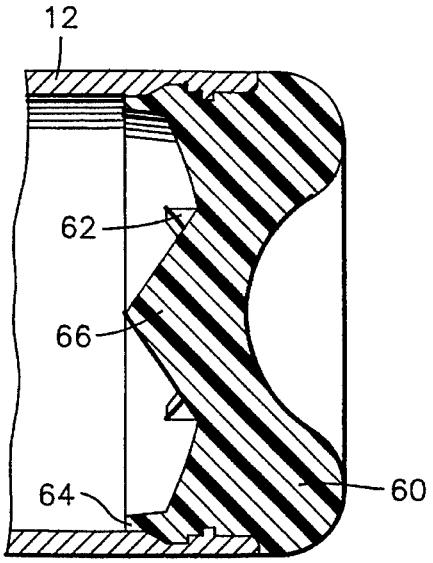
FIG. 5 is a sectional view illustrating another embodiment of the improved end cap illustrating the addition of a conical weight area incorporated into the end cap.

FIG. 5 illustrates another concave end cap construction with an end wall 60, ribs or flanges 62 extending between the inner surface of the end wall and a reduced diameter portion 64 in the same manner as shown and described in FIGS. 3 and 4. In this form of the invention, a conically shaped weight 66 extends inwardly from the inner surface of the end wall 60 with the apex of the conical weight 66 terminating in alignment with the inner end of the reduced cylindrical portion 64. The ribs or flanges 62 still extend from the periphery of the conical weight to the inner surface of the reduced diameter portion 64 in order to provide additional rigidity to the reduced diameter portion 64.

As illustrated in FIG. 5, the central longitudinal axis of the conical weight is preferably coincident with the central axis of the concave portion of the end cap and central longitudinal axis of the bat and barrel. However, some variation can be tolerated so long as the balance of the bat is maintained. The conical weight 66 moves the weight center of the end cap illustrated in FIG. 5 further inwardly in relation to the end of the barrel 12 of the bat. The external configuration of the end wall and reduced end portion in FIG. 5 is the same as that in FIG. 4.

Figure 6:
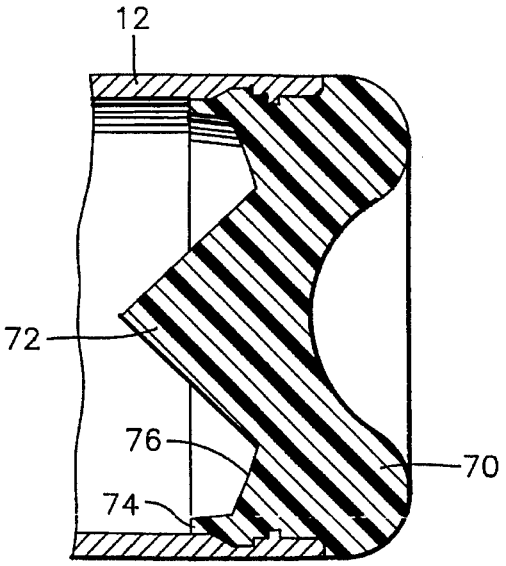
FIG. 6 is a sectional view similar to FIG. 4 illustrating another embodiment of the improved end cap in which the conical weight area extends beyond the inner end of the end cap.

FIG. 6 illustrates yet another concave end cap construction with an end wall 70 having the same external shape as the end cap described for FIGS. 4 and 5. However, in this embodiment, the end cap is provided with a conical weight 72 which extends axially inwardly beyond the inner end of the reduced diameter portion 74. The radial ribs or flanges 76 remain the same with the difference between FIGS. 5 and 6 constructions being the axial inward extent of the weights 66 and 72. This provision of the conical weight 66 or 72 moves the center of the entire weight of the end cap further axially inwardly in relation to the end of the barrel 12 thus moving the weight center closer to the handle portion 14 and closer to the optimum area of the barrel to be impacted against a ball.

Shifting the weight center closer to the handle results in a dampening of the vibrations in the bat caused by impact with the ball which are usually transmitted to the hands gripping the handle portion during the striking of the ball. Further, this shifting of the bat weight center toward the handle reduces the lever arm between the handle portion and the center of the weight load to enhance the capability of the batter accelerating the barrel end of the bat when the bat is passing through the portion of the swing when the hands and wrists of the batter move through a position in which the bat speed is accelerated as the wrists of the batter move from a "cocked" to a "uncocked" position, thereby enhancing the impact force imparted to the ball.

While the conical weight feature of the present invention has been illustrated and described in combination with the concave end cap construction of this invention, it will be appreciated by those skilled in the art that the conical weight feature can be incorporated in a conventional end cap without departing from the present invention. Further, the concave end cap and conical weight concepts have been disclosed herein with the preferred straight barrel construction as disclosed in applicant's parent application, Ser. No. 08/099,348. Those skilled in the art will appreciate that the concave end cap and conical weight features of this invention can be separately or together included in the conventional aluminum bat construction where the tubular barrel is presently crimped or narrowed in order to accommodate the standard end cap.

The foregoing is considered as illustrative only of the principles of the invention. Further, since numerous other modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An aluminum bat comprising a handle portion and a tubular barrel having a substantially constant external diameter area defining a hitting zone extending to an end remote from the handle portion and an end cap having a short peripheral portion with an external diameter equal to the external diameter of the barrel, said end cap including a reduced diameter inner end portion telescoped into the end of the barrel for mounting the end cap on the barrel, said tubular barrel including a peripheral groove in the internal surface thereof adjacent said end of the bat remote from said handle portion, said reduced diameter inner end portion of the end cap including a peripheral ridge projecting into said groove for anchoring the end cap to the barrel, said end cap including an end wall with a concave recess extending inwardly from an axial outer surface of the end wall thereby moving the weight center of the end cap axially inwardly in relation to the end of the barrel closer to the handle portion of the bat and closer to the optimum area of the barrel hitting zone to be impacted with a ball.

2. The bat as defined in claim 1 wherein said end wall and reduced inner end portion are interconnected by internal reinforcing ribs extending from the center of an axial inner surface of the end wall to an inner surface of the reduced end portion of the end cap.

3. The bat as defined in claim 2 wherein the inner surface of said end wall being concavely curved and generally coinciding with and spaced from the concave recess in the axial outer surface of the end wall.

4. The bat as defined in claim 1 wherein an axial inner surface of the end wall is provided with an axially inwardly extending conical weight area to move the weight center of the end cap further axially inwardly.

5. The bat as defined in claim 4 wherein said conical weight includes an apex terminating generally in alignment with an axially inner end of the reduced end portion of the end cap.

6. The bat as defined in claim 4 wherein said conical weight includes an apex extending axially inwardly beyond the axial inner end of said reduced end portion of the end cap.

7. The bat as defined in claim 3 wherein an axial inner surface of the end wall is provided with an axially inwardly extending conical weight area to move the weight center of the end cap further axially inwardly.

8. The bat as defined in claim 7 wherein said conical weight includes an apex terminating generally in alignment with an axially inner end of the reduced end portion of the end cap.

9. The bat as defined in claim 7 wherein said conical weight includes an apex extending axially inwardly beyond the axial inner end of said reduced end portion of the end cap.

10. The bat as defined in claim 4 wherein said end wall, reduced diameter inner end portion, short peripheral portion and weight area of said end cap being of unitary plastic construction.

11. The bat as defined in claim 2 wherein said end wall, reduced diameter inner end portion, short peripheral portion and internal reinforcing ribs of said end cap being of unitary plastic construction.

12. An end cap for the tubular barrel of a hollow bat, said end cap comprising an end wall adapted to form a closure for the end of the barrel, a short peripheral portion on said end wall having an external diameter adapted to engage the end of the barrel and form a continuation of the barrel, said end cap including an axially extending reduced diameter portion adapted for telescopic insertion into the end of the barrel, said end cap forming a weight balanced about a longitudinal axis of the end cap, said longitudinal axis of the end cap adapted to be oriented coincidental to a longitudinal axis of the bat, said end wall including a concave recess in an outer surface thereof thereby moving the weight center axially inwardly in relation to the end cap.

13. The end cap as defined in claim 12 wherein said end wall includes a plurality of radially extending reinforcing ribs connecting the inner surface of the end wall with the inner surface of the reduced end portion.

14. The end cap as defined in claim 12 wherein said end wall includes an axially inwardly extending weight area projecting from the inner surface of said end wall.

15. The end cap as defined in claim 14 wherein said end wall includes a concave inner surface, said weight area being a conical weight having an inwardly disposed apex, said conical weight being concentrically balanced and spaced equally from said reduced diameter portion of said end cap.

16. The end cap as defined in claim 12 wherein said reduced diameter portion includes a peripheral ridge adapted to extend into a peripheral groove in the barrel of the bat for anchoring the weight to the bat.

* * * * *